US009018558B2

(12) United States Patent
Sainz de la Maza Escobal et al.

(10) Patent No.: US 9,018,558 B2
(45) Date of Patent: Apr. 28, 2015

(54) GAS CIRCUIT BREAKER

(75) Inventors: Norberto Sainz de la Maza Escobal, Igorre (ES); Juan María Casado Cartón, Igorre (ES); José Manuel Inchausti Sancho, Igorre (ES); José María Torres Novalbos, Igorre (ES)

(73) Assignee: Ormazabal Y CIA, S.L., Igorre (Viscaya) (ES)

( * ) Notice: Subject to any disclaimer, the term of this patent is extended or adjusted under 35 U.S.C. 154(b) by 225 days.

(21) Appl. No.: 13/701,188

(22) PCT Filed: May 31, 2010

(86) PCT No.: PCT/ES2010/070363

§ 371 (c)(1),
(2), (4) Date: Nov. 30, 2012

(87) PCT Pub. No.: WO2011/151476

PCT Pub. Date: Dec. 8, 2011

(65) Prior Publication Data

US 2013/0062313 A1 Mar. 14, 2013

(51) Int. Cl.
*H01H 9/30* (2006.01)
*H01H 33/70* (2006.01)
(Continued)

(52) U.S. Cl.
CPC ..... *H01H 33/7069* (2013.01); *H01H 33/12* (2013.01); *H01H 33/185* (2013.01); *H01H 33/76* (2013.01); *H01H 33/91* (2013.01); *H01H 33/18* (2013.01)

(58) Field of Classification Search
CPC .. H01H 33/91; H01H 33/7023; H01H 33/901
USPC ..... 218/62, 143, 43, 60
See application file for complete search history.

(56) References Cited

U.S. PATENT DOCUMENTS 3,586,804 A 6/1971 Schramm et al.
5,151,566 A * 9/1992 Koyanagi et al. ..... 218/62
(Continued)

FOREIGN PATENT DOCUMENTS

DE 39 15 700 A1 11/1990
DE 90 16 830 U1 2/1991
(Continued)

OTHER PUBLICATIONS

International Search Report dated Feb. 10, 2011 issued in corresponding international patent application No. PCT/ES2010/070363.
(Continued)

*Primary Examiner* — Truc Nguyen
(74) *Attorney, Agent, or Firm* — Ostrolenk Faber LLP

(57) ABSTRACT

The disclosure relates to a gas circuit breaker switch (5) which can be integrated inside a switching device insulated in a dielectric gas, said switch (5) comprising an arc chute (1) inside which a fixed contact (3) and a moving contact (4) are arranged. The integration of the contacts (3, 4) inside at least one casing (19, 20) corresponding to the arc chute (1) allows reducing distances between phases, in addition to preventing any incident in one phase from affecting the remaining phases, and finally more compact electrical equipment is obtained. The switch (5) also comprises at least one generation means (6) for generating at least one gas, at least one blowout/intake means (7) for at least one extinguishing gas and at least one generation means (2) for generating a magnetic field, such that the electric arc generated between the contacts (3, 4) of the switch (5) can be extinguished by combining said means (6, 7, 2).

16 Claims, 5 Drawing Sheets

(51) Int. Cl.

| | |
|---|---|
| ***H01H 33/76*** | (2006.01) |
| *H01H 33/12* | (2006.01) |
| *H01H 33/18* | (2006.01) |
| *H01H 33/91* | (2006.01) |

(56) References Cited

U.S. PATENT DOCUMENTS

| | | | | | |
|---|---|---|---|---|---|
| 5,225,642 | A | * | 7/1993 | Yamamoto et al. | 218/143 |
| 5,567,924 | A | * | 10/1996 | Yano et al. | 218/143 |
| 5,723,840 | A | | 3/1998 | Bojic et al. | |
| 5,750,949 | A | * | 5/1998 | Rees et al. | 218/43 |
| 5,808,257 | A | * | 9/1998 | Thuries | 218/60 |
| 5,902,978 | A | | 5/1999 | Zehnder et al. | |
| 6,107,590 | A | | 8/2000 | Skindhoj et al. | |
| 6,252,190 | B1 | | 6/2001 | Niemeyer | |
| 6,831,828 | B2 | * | 12/2004 | Aoki et al. | 361/619 |

FOREIGN PATENT DOCUMENTS

| | | | |
|---|---|---|---|
| EP | 0 959 483 | T3 | 9/2006 |
| ES | 2 259 202 | T3 | 11/1999 |
| ES | 2 259 203 | T3 | 9/2006 |

OTHER PUBLICATIONS

Written Opinion dated Feb. 10, 2011 issued in corresponding international patent application No. PCT/ES2010/070363.

International Preliminary Report on Patentability dated Aug. 30, 2012 issued in corresponding international patent application No. PCT/ES2010/070363.

* cited by examiner

GAS CIRCUIT BREAKER

CROSS REFERENCE TO RELATED APPLICATIONS

The present application is a 35 U.S.C. §371 National Phase conversion of PCT/ES2010/070363, filed May 31, 2010, the disclosure of which is incorporated herein by reference. The PCT application was published in the Spanish language.

TECHNICAL FIELD OF THE INVENTION

The invention relates to a gas circuit breaker switch which can be applied in high-voltage electric switchgear, such as in switching devices for example, in which a gas or mixture of gases with high dielectric rigidity is used as the extinguishing and insulating means.

The switch object of the present invention comprises an arc chute provided with at least one generation means for generating at least one gas, with at least one blowout/intake means for at least one gas and with at least one generation means for generating a magnetic field, such that the electric arc generated between the contacts of the switch can be extinguished by the combination of said means.

BACKGROUND OF THE INVENTION

Medium- or high-voltage electric switches are occasionally installed in electric equipment, such as switching devices for example, in which said switches are incorporated in their corresponding compartment. The compartment of the switch requires using an insulating medium, which can be air or another gas medium, such as, for example, sulfur hexafluoride ($SF_6$), dry air, nitrogen, etc., for the purpose of reducing the distance between phases and thus achieving a compact enclosure that is invariable to external or environmental conditions such as contamination or humidity.

As is known, medium- or high-voltage electric switches are provided for interrupting/cutting off the current circulating through the line at a determined time and can reach the interruption/cut-off value of the apparatus, an electric arc being produced at the time of the separation of the contacts of the switch which can damage them. This is an unwanted phenomenon that has to be extinguished as quickly as possible, given that the arc can destroy the insulations and the contacts, as well as cause an abrupt increase of temperature and pressure which can cause explosions that produce material damages, the formation of toxic gases or even personal injuries. Therefore, the opening/cut-off time is essential.

Another situation that can occur are the closings against short-circuits, i.e., those cases in which a fault is generated when the circuit is closed. In this case, an increase of the current passing through the contacts occurs, reaching several kA, and the contacts are furthermore eroded due to the pre-arc.

In order to limit the wear of the contacts as much as possible, the switch opening operation should be as quick as possible so that the contacts are separated quickly as well. To that end, electric switches use mechanical, hydraulic or electric drives, as well as extinguishing means for extinguishing the arc generated at the time the switch is open, such as for example magnetic blowout systems, static arc lamination and cooling systems, gas fin blowout systems, piston blowout systems, explosive charge detonation systems, systems for ablating a material that can emit a gas to aid in extinguishing the arc, etc.

In the mentioned piston blowout systems, the switch is associated with the piston of a cylinder inside which a gas is located, such that when the switch is open, its movement causes the piston to shift, compressing the gas contained in the chamber of the cylinder, or also referred to as compression chamber, and projecting it on the arc generated at the time of opening the switch, causing it to be extinguished.

These piston blowout arc extinguishing systems have the drawback that when the switch closing operation is performed, the piston must exert considerable force for its retraction since its movement depends on the filling speed of the compression chamber and this filling is done slowly because it is done by taking in gas through the small openings of the chamber. This causes the retraction of the piston to be very slow and the arc that is generated during the closing of the switch can erode the contacts thereof. The gas entering the chamber is also contaminated gas, which can cause unwanted consequences in the next switch opening operation.

In relation to piston blowout systems of this type involving the aforementioned problems, U.S. Pat. No. 5,723,840 and U.S. Pat. No. 5,902,978 can be mentioned as examples.

The solution defined in U.S. Pat. No. 5,723,840 relates to a switch comprising a piston blowout system, which piston is stationary and independent from the moving contact, such that the shifting of the moving contact causes the compression of gas against the stationary piston and consequently the expulsion of said gas through an outlet conduit towards the arcing chamber. Furthermore, in the switch closing operation the compression chamber is filled with gas coming from a suction chamber, the gas passing from one chamber to another through a one-way flow valve comprised in the same piston. In said refreshing of the dielectric medium, the gas coming from the suction chamber is a contaminated gas, because in the opening operation the gases are discharged into said suction chamber, where they are mixed with non-contaminated gas from the exterior, so said mixture of gases with impurities adversely affects the next opening operation.

U.S. Pat. No. 5,902,978 relates to a switch comprising a piston blowout system provided with more than one piston. The movement of these pistons depends on the shifting of the moving contact of the switch, such that said pistons are associated with the moving contact by means of a mechanical transmission such as a cog wheel engaged with the moving contact. The use of the mentioned mechanical transmission involves a complex design consisting of several members, such as, for example, cog wheels, drive transmission members, etc., which in turn involve the drawback of an increase of the size of the switch, whereby the switching devices in which said switch is installed comprise a larger volume, resulting in space problems in the installations. The use of said complex mechanical transmission also involves a higher probability of a malfunction in its operation.

On the other hand, with respect to the problem comprised in piston blowout systems in reference to the retraction speed of the pistons in switch closing operations, the use of more than one piston, as occurs in U.S. Pat. No. 5,902,978, even further affects the shifting speed of the moving contact of the switch in its closing operation, this shifting being slower, so the arc generated between the contacts of the switch has more time to erode such contacts.

In addition to the technical problems considered above in relation to U.S. Pat. No. 5,902,978, it is necessary to mention the insufficiency of means in discharging the gases in when performing the operations of the switch. U.S. Pat. No. 5,902,978 only has one gas outlet in which there is a gas flow deflector. In this sense, in addition to comprising only one gas discharge route, the gas deflector can act as a stopper, blocking the exit of said gases. Consequently, after an operation of the switch the arcing chamber is contaminated for the next operation. On the other hand, this solution defined in U.S. Pat. No. 5,902,978 does not comprise any system for regenerating gas, so the gas used in the next operation will be a gas full of impurities which probably does not aid in extinguishing the electric arc.

Another technical problem comprised in existing piston blowout systems, such as the blowout systems defined in the aforementioned patents, for example, relates to the area in which the electric arc is attacked by means of the blowout, i.e., for example in U.S. Pat. No. 5,723,840 and U.S. Pat. No. 5,902,978 the compressed gas is blown on the arc through an outlet conduit directing the gas on said arc without having any defined point of attack on said arc. By means of this undefined blowout without any point of attack on the arc, the contaminated gases and the plasma generated during the operation of the switch may not be routed to their respective discharge area, a dispersion thereof occurring in the arcing chamber, and consequently, the arc being able to be formed or shifted on the main arc contact and not on the fixed arc contact, causing damages in the main arc contact.

In electric switches the passage of the rated current is generally done in a main circuit provided with at least one fixed contact and at least one moving contact. There are switches which furthermore comprise a secondary or auxiliary circuit provided with contacts, referred to as arc contacts, which stop conducting current after opening the contacts of the main circuit and allow conducting the current before closing the contacts of the main circuit, i.e., the electric arc is formed between said arc contacts. In this sense, some patents defining solutions of this type can be cited, such as for example patents ES2259202T3 and ES2259203T3, which relate to a self-expansion switch comprising in one and the same fixed contact a main contact which allows the rated current to pass and an arc contact for the time of cutting off the current, thus preventing the deterioration of the main contact due to the electric arc generated in cutting off the current. It also allows obtaining a more compact arc chute.

In these patents ES2259202T3 and ES2259203T3, the discharge of the gases caused in the switch cut-off operation are expelled from the arc chute through the inner gap of the moving contact. However, as occurs in the previously mentioned examples, there may be gas and plasma residues caused in the cut-off due to the fact that there is a single discharge route. Consequently, the arc chute is not free of impurities that may jeopardize the next operation. Nor is there any system for regenerating the gas contained in the arcing chamber in these solutions either.

These last two solutions comprise a magnetic blowout system as the arc extinguishing means, such that the fixed contact comprises an electromagnetic coil to rotate the arc. When the contacts separate, the electric arc occurs, the coil is excited and therefore a magnetic field is generated, causing the electric arc to rotate around the arc contact.

The explosive charge detonation systems used as electric arc extinguishing means involve explosive charges which are installed in the arcing chamber of the switches and which, when said charges are detonated by the occurrence of the electric arc, the pressure of the gases generated in said chamber aids in opening the contacts of the switch. In this sense, some patents, such as U.S. Pat. No. 6,107,590 and U.S. Pat. No. 6,252,190, for example, can be cited.

U.S. Pat. No. 6,107,590 relates to a switch comprising an explosive charge detonation system incorporated in the arcing chamber. In the switch opening operation, when the separation between the fixed contact and the moving contact occurs, an arc occurs between them, leading to the detonation of the explosive charge. This detonation causes an overpressure in the arcing chamber which causes the thrust of at least one piston which is integral with the moving contact, such that said generated overpressure contributes to said contact shifting towards the opening of the switch.

In this latter US patent, as occurs in the previous examples, the arcing chamber is not free of contamination after a switch opening operation, nor does it have a system for regenerating the gas contained therein, so the next operation could be jeopardized since there is no pure dielectric medium. The same occurs with the solution described in patent U.S. Pat. No. 6,252,190, which defines a switch comprising an explosive charge for its detonation at the time the arc occurs, aiding the generated overpressure in said detonation to obtain a quicker separation of contacts. As in the previous example, in said patent there is also at least one piston integral with the moving contact which is thrust by the pressure generated in the arcing chamber due to the generation of the gas in the detonation of the explosive charge. This U.S. Pat. No. 6,252,190 also mentions that the switch comprises an ablative material for extinguishing the arc. A portion of the fixed contact of the switch is made of said ablative material, a sliding contact being the one established between the moving contact, specifically the piston, and this portion of the fixed contact, such that due to the arc generated in the separation of the contacts, said consumable portion of the fixed contact releases a gas which aids in extinguishing the arc.

Patent EP0959483 can also be cited as another example of the state of the art, in which the switch comprises extinguishing plates which, when the temperature increases due to the arc generated in the separation of the contacts, said plates release a gas which aids in cooling and extinguishing the electric arc as quickly as possible. This solution does not provide a piston blowout system, but rather the pressure generated in the disconnection causes a stream of gas which aids in cooling and putting out the electric arc.

A device which allows a very quick and efficient extinction of the arc is therefore necessary.

SUMMARY OF THE INVENTION

The switch object of the present invention which can be applied in electric power distribution networks relates to a switch that can be installed in electric equipment, such as switching devices for example, in which said switch is integrated in its corresponding compartment and insulated in a dielectric gas medium, such as air for example or another gas medium, such as for example sulfur hexafluoride ($SF_6$), dry air, nitrogen, $CO_2$, etc., for the purpose of reducing the distance between phases and thus achieving a compact enclosure and internal conditions that are invariable to external or environmental conditions such as contamination or humidity.

The gas circuit breaker switch comprises one arc chute for each phase, at least partially comprising inside said arc chute a fixed contact and a moving contact, and an arcing chamber inside which an electric arc can occur in the opening and closing of the switch. The entire assembly is insulated in at least one dielectric gas, inside a switching device of electric switchgear.

According to the present invention, the switch comprises a generation means for generating at least a first extinguishing gas defining a pinching area in the arcing chamber, along which the moving contact can move in the opening and closing of the switch, and in that at least a portion of the generation means for generating the first extinguishing gas is attached to and shifts integrally with the moving contact such that the shifting of the moving contact through the pinching area forces the electric arc to stretch and remain in continuous contact with the generation means for generating the first extinguishing gas due to the passage of the moving contact through the pinching area, causing the generation of the mentioned first extinguishing gas which allows extinguishing said electric arc. With this configuration the electric arc is forced to follow a path in which the entire arc is in contact with the generation means and thus the first extinguishing gas acts directly on the entire electric arc, achieving greater effectiveness in its extinction.

The generation means for generating at least a first extinguishing gas of the electric arc comprises a thermoplastic material of high rigidity, tenacity and dimensional stability, such as POM (polyoxymethylene) for example. Due to the increase of the temperature generated by the electric arc in the separation of the contacts of the switch, said means generates a first extinguishing gas which aids in cooling and extinguishing the electric arc.

The switch additionally comprises a blowout/intake means for at least a second extinguishing gas, configured to direct the mentioned second extinguishing gas on the electric arc allowing extinguishing the electric arc in the opening of the switch and refreshing the gas in the arc chute in the closing of the switch.

The blowout/intake means comprise at least one piston integral with the moving contact of the switch, such that in the opening of the switch, said piston compresses the gas located in at least one compression chamber and pushes it towards the arcing chamber for blowing on the electric arc.

The compression chamber can be communicated by means of at least one opening with at least one outlet conduit through which the compressed gas is directed towards the arcing chamber.

The fixed contact and the moving contact of the switch can comprise at least one arc contact (consisting of a conductive material such as copper tungsten for example) such that in the opening/closing of the switch, when the fixed and mobile contacts are separated or in the instant prior to the fixed and mobile contacts joining together, the electric arc is formed between the mentioned arc contacts of the fixed contact and of the moving contact. In this sense, the blowout/intake means allow blowing on the electric arc by giving off a jet of the second extinguishing gas into the arcing chamber through at least one outlet conduit, and specifically on the intermediate area of both arc contacts, allowing by means of said blowout the shearing and cooling of said arc for its subsequent extinction.

The possibility of said jet of the second extinguishing gas being able to be directed to both the front portion and to the rear portion of the arc contact corresponding to the fixed contact has been contemplated. The arc is thus attacked at determined strategic points and it is assured that the gases and the plasma generated are routed towards their corresponding discharge area, preventing the dispersion thereof in the arcing chamber and the arc being able to be formed on the fixed contact of the switch and damaging it.

On the other hand, the blowout/intake means can allow refreshing the gas in the arc chute by making use of the switch closing operation. In the switch closing operation, the shifting of the moving contact causes the piston to shift with it, which causes a negative pressure in the compression chamber. Due to this negative pressure, the compression chamber is filled with new gas through at least one inlet comprised in the arc chute and which is located on the opposite side farthest from the arcing chamber, thus assuring the entrance of clean gas coming from an outer area the farthest possible from the arcing chamber, in which there can be remains of contaminated gas, thus having new gas for the next operation of the switch. At least one inlet through which the new gas enters comprises at least one closure means preventing the exit of gas in the switch opening operation and allows the entrance of new gas in the switch closing operation, such that the retraction of the piston in the closing operation does not slow down the shifting of the moving contact, and therefore, the electric arc generated does not have enough time to damage the contacts.

The switch can comprise at least one generation means for generating a magnetic field allowing the electric arc to shift on the contacts. This generation means for generating a magnetic field can be installed around the fixed contact such that when the separation of the fixed and mobile contacts occurs, the occurrence of the electric arc causes the excitation of said generation means, and therefore a magnetic field is generated, causing the electric arc to shift on the arc contact. The generation means for generating the magnetic field can consist of an electromagnetic coil.

The arc chute relating to each phase is configured in at least one casing which at least partially incorporates the fixed contact and the moving contact of the switch. In one embodiment of the invention, the possibility of said arc chute being configured in two parts has been contemplated, a first part which at least partially incorporates the fixed contact and a second part which at least partially incorporates the moving contact. This arrangement of the arc chute in which the contacts of each phase of the switch are integrated in their corresponding casing allows protecting an isolating each of the phases of the switch from the remaining phases due to any incident. With the incorporation of the fixed and mobile contacts of the switch inside a casing, the distances between phases are also reduced, thus achieving more compact electric equipment.

The fixed contact and/or the moving contact of the switch, as well as the generation means for generating at least a first extinguishing gas integral with the moving contact, comprise a hollow internal configuration, which allow discharging gases and plasma through said hollow internal portion caused by the electric arc during the opening/closing of the switch, which thus aids in discharging the contaminated gas from the arcing chamber and keeping it free of contamination for the next operation of the switch. The hollow internal portion of the fixed contact is also communicated through at least one opening with at least one gas discharge area, said discharge area being located in the first part corresponding to the arc chute, such that a greater sweeping of gases and plasma caused in the opening/closing of the switch is performed, keeping the arcing chamber as clean as possible for the next operation of the switch.

BRIEF DESCRIPTION OF THE DRAWINGS

To complement the description and for the purpose of aiding to better understand the features of the invention according to a preferred practical embodiment thereof, a set of drawings is attached as an integral part of said description in which the following has been depicted with an illustrative and non-limiting character.

DESCRIPTION OF PREFERRED EMBODIMENTS

Figure 1:
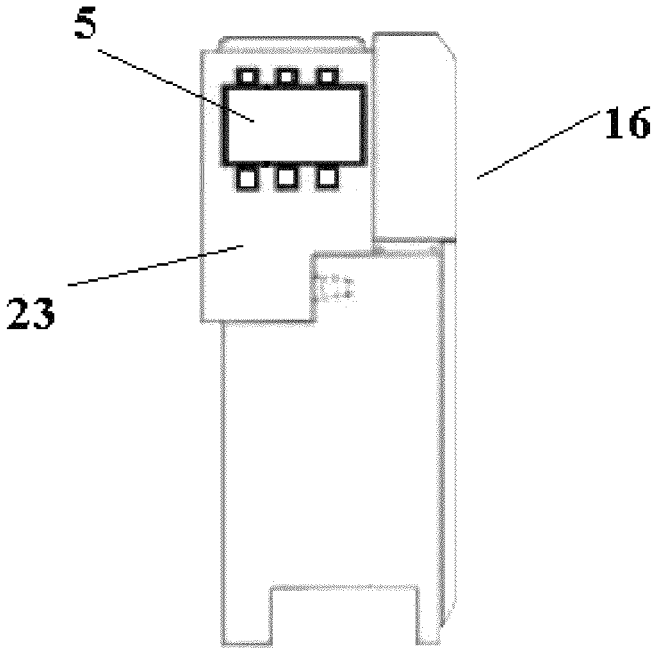
FIG. 1 depicts a side view of a switching device (16) which shows the arrangement of the switch (5) inside its corresponding compartment (23) insulated in gas.

As can be seen in FIG. 1, the gas circuit breaker switch (5) of the invention is installed inside a switching device (16), which comprises several compartments, one of them being the compartment (23) corresponding to the switch (5). This compartment (23) of the switch (5) is sealed and pressurized in an insulating gas, such as, for example, SF6, dry air, nitrogen, $CO_2$, etc., such that the distance between phases can be reduced, and consequently, more compact switching devices are obtained which minimize space problems in the installations. A compact enclosure and an environment therein which is invariable to external or environmental conditions such as contamination or humidity are also achieved by means of the gas insulation.

Figure 2:
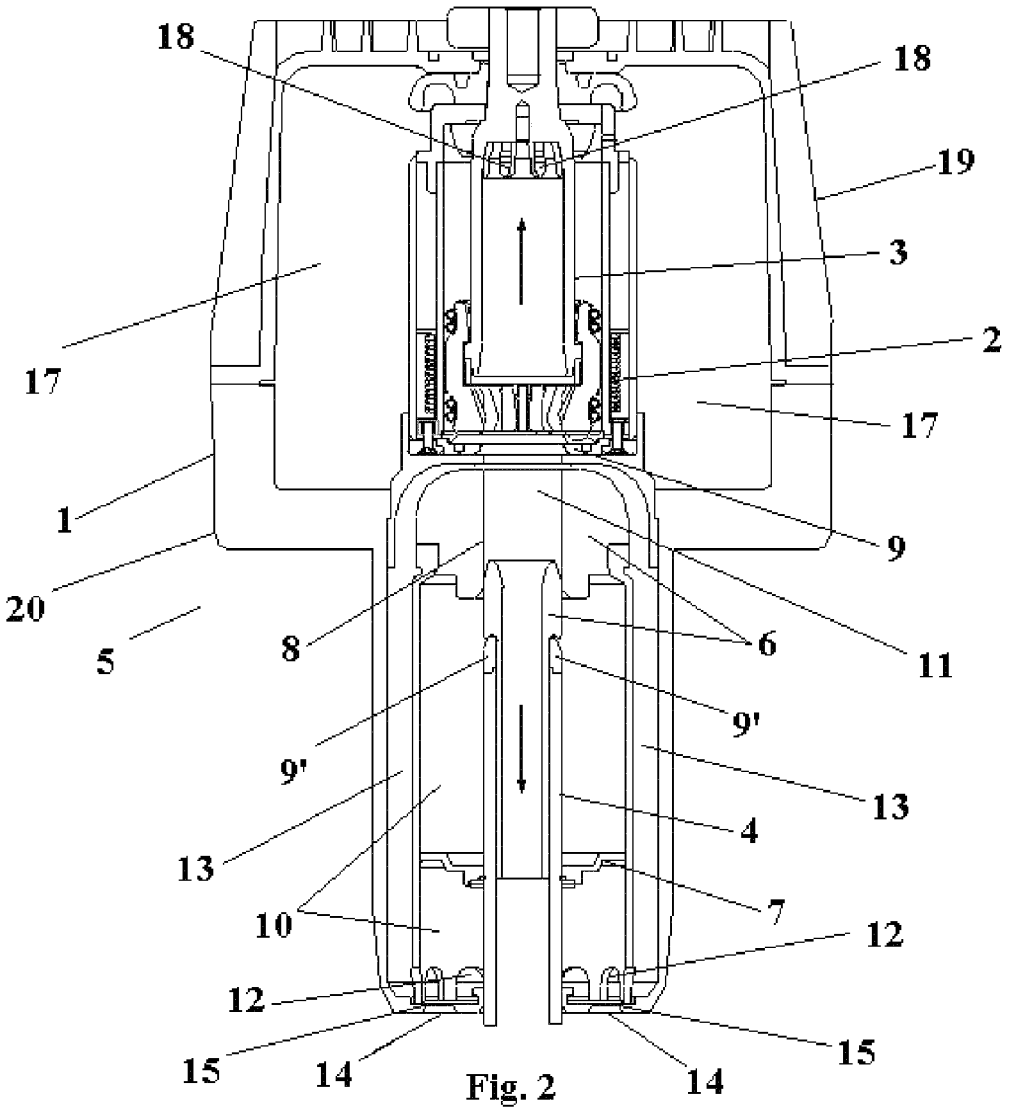
FIG. 2 depicts a cross-sectional view of a first embodiment of the switch (5), in which a first embodiment of the arcing chamber (11) for blowing on the electric arc is shown.
Figure 4:
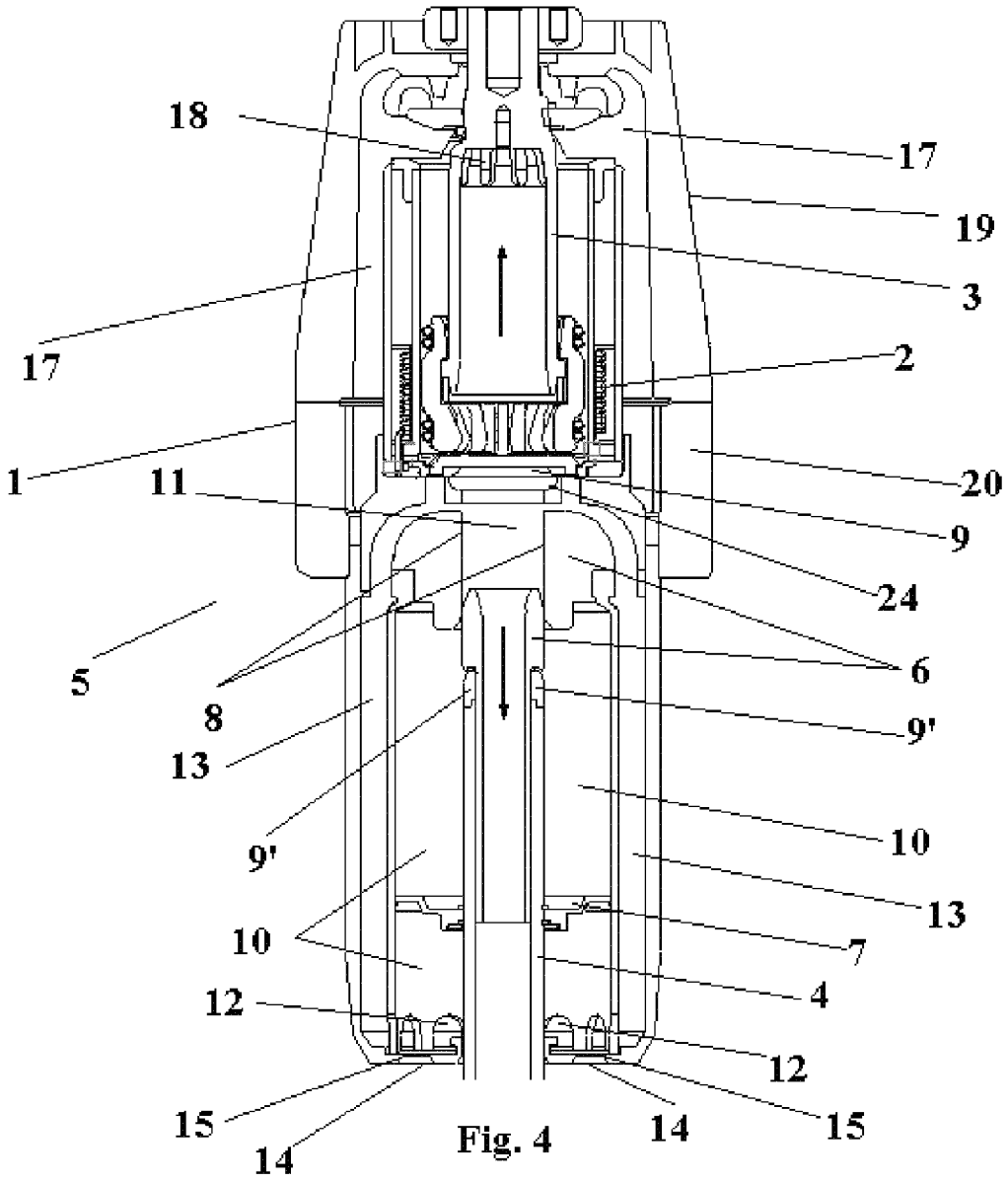
FIG. 4 depicts a cross-sectional view of a second embodiment of the switch (5), in which a second embodiment of the arcing chamber (11) for blowing on the electric arc is shown.

As is shown in FIGS. 2 and 4, the gas circuit breaker switch (5), comprises an arc chute (1) which at least partially incorporates a fixed contact (3) and a moving contact (4). Said arc chute (1) can be structured in two parts, a first part (19) which incorporates the fixed contact (3) and a second part (20) which incorporates the moving contact (4), such that by means of encapsulating the contacts (3, 4) each of the phases is protected and isolated from the remaining phases in any incident. The encapsulation of each phase also allows reducing the distance between them.

FIGS. 2 to 5 show a gas circuit breaker switch (5) comprising a generation means (6) for generating at least a first extinguishing gas along at least one pinching area (8), a blowout/intake means (7) for at least a second extinguishing gas and a generation means (2) for generating a magnetic field allowing the electric arc to shift on the contacts (3, 4), such that extinguishing the electric arc generated between the contacts (3, 4) is assured in the switch opening operation by means of the combination of these three means in a reduced time in which the electric arc causes minimal damage in said contacts (3, 4).

As is shown in FIGS. 2 to 5, the generation means (6) for generating a first extinguishing gas forms a pinching area (8) which in the separation of the contacts (3, 4) forces the electric arc to stretch and remain in continuous contact with the generation means (6). Said generation means (6) consist of a thermoplastic material, such as the polyoxymethylene, for example, which, due to the high temperature reached by the arc, generates a gas which allows cooling and extinguishing the electric arc.

FIGS. 2 to 5 also show how a portion of these generation means (6) for generating a first extinguishing gas is attached to and shifts integrally with the moving contact (4) of the switch (5), this moving contact (4) passing through the pinching area (8) both in the opening/cut-off operation of the switch (5) and in the closing operation thereof, thus forcing the electric arc to pass through a path in which it is surrounded by and in continuous contact with the generation means (6).

The blowout/intake means (7) for at least a second extinguishing gas comprises at least one piston integral with the moving contact (4) of the switch (5), as is seen in FIGS. 2 and 4, such that it allows extinguishing the electric arc in the opening/cut-off of the switch (5) and refreshing the gas in the arc chute (1) in the closing of the switch (5).

Figure 3:
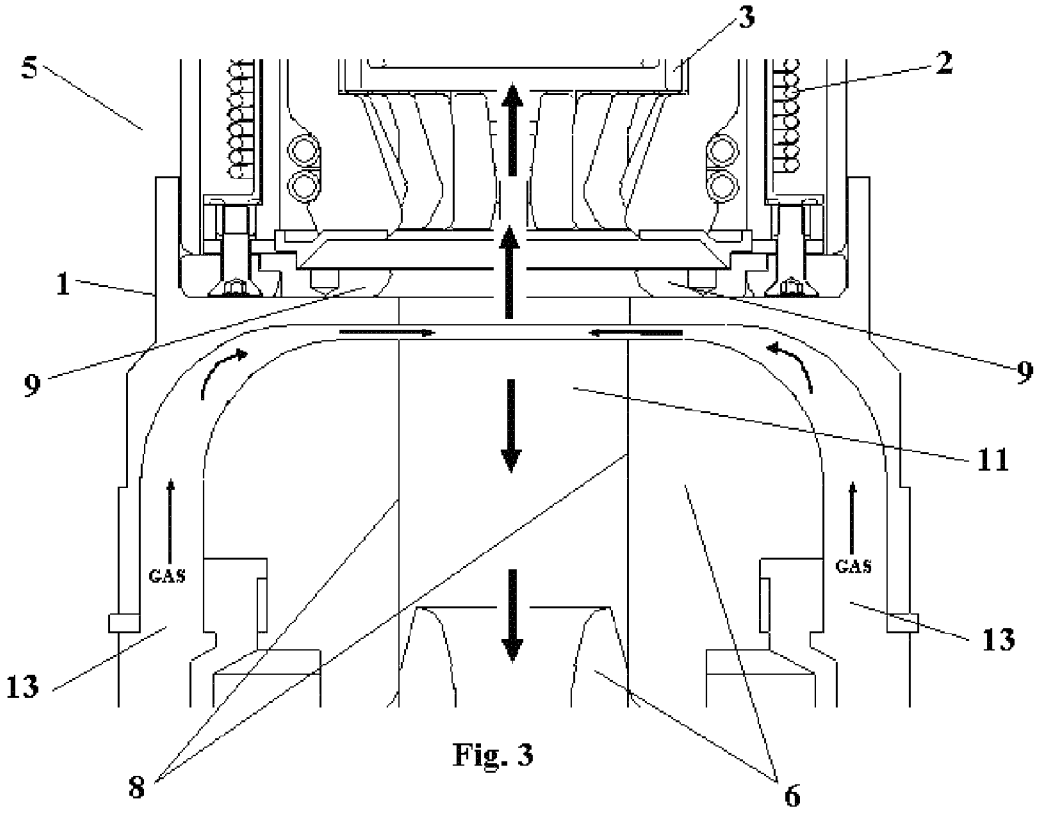
FIG. 3 depicts a detail of the arcing chamber (11) according to the embodiment of the invention of FIG. 2.

In the opening/cut-off operation of the switch (5) the piston (7) shifts together with the moving contact (4) and causes the compression of the second extinguishing gas located in a compression chamber (10). This compressed gas is thrust through at least one outlet conduit (13) towards an arcing chamber (11), the compression chamber (10) and the outlet conduit (13) being communicated through at least one opening (12). In the opening/cut-off of the switch (5), when the fixed (3) and mobile (4) contacts are separated, the electric arc is formed between at least an arc conducting means (9) of the fixed contact (3) and at least another arc conducting means (9') of the moving contact (4), said at least two arc conducting means (9,9') consisting of the arc contacts of the switch (5), these arc conducting means (9,9') being able to be made in a copper tungsten alloy. In this sense, the blowout/intake means (7) allow blowing on the electric arc by giving off a jet of the second extinguishing gas into the arcing chamber (11) through at least one outlet conduit (13), and specifically on the intermediate area of both arc conducting means (9,9'), as is seen in FIGS. 2 and 3, allowing by means of said blowout the shearing and cooling of said arc for its subsequent extinction. At the same time, the deterioration of the main contacts (3, 4) is prevented given that the electric arc is formed between the arc conducting means (9,9').

Figure 5:
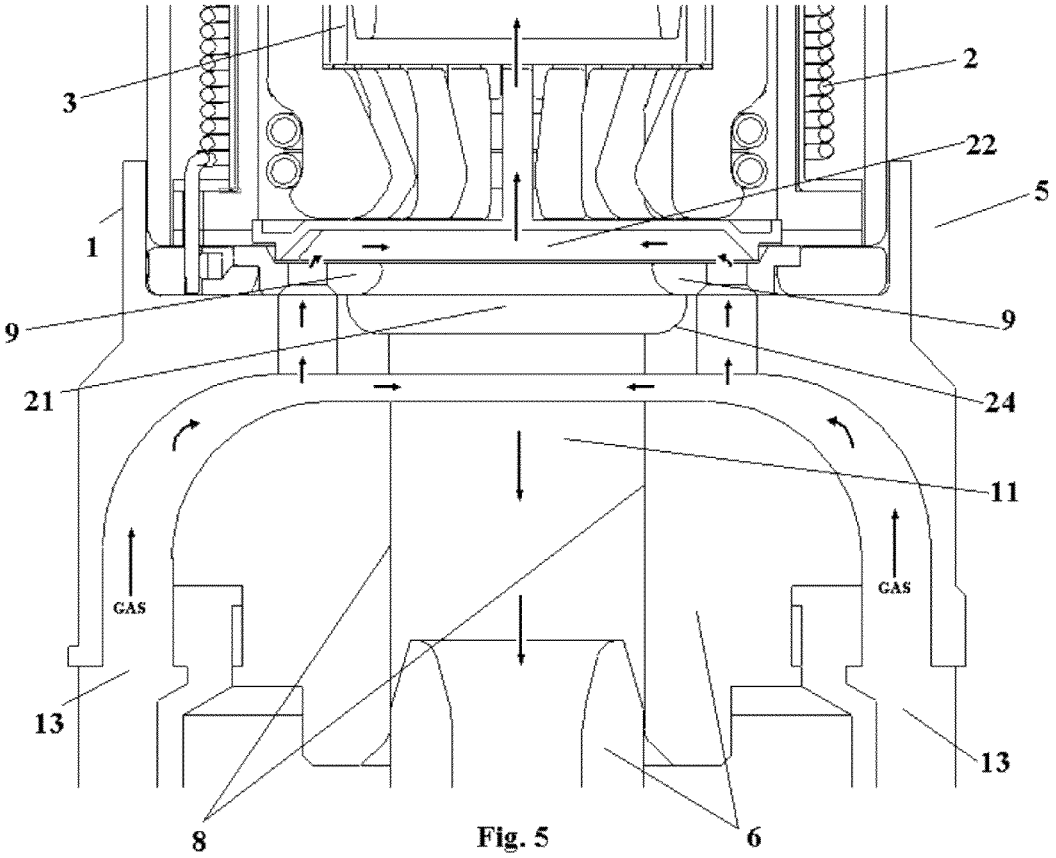
FIG. 5 depicts a detail of the arcing chamber (11) according to the embodiment of the invention of FIG. 4.

In a second possible embodiment of the invention, as is shown in FIGS. 4 and 5, both the front portion (21) of the arc conducting means (9) and the rear portion (22) of said arc conducting means (9) blow the second extinguishing gas against the electric arc in the arcing chamber (11). It thus prevents the gases and the plasma caused by the arc from being dispersed and being able to cause the arc being formed on the fixed contact (3). The possibility that a blowout coil (24) configured to conduct the gases generated by the electric arc towards the inside of the fixed (3) and mobile (4) contacts can be arranged under the arc conducting means (9) has also been contemplated for the purpose of facilitating the gas discharge through the contacts (3) and (4). Therefore, as a result of this form of blowing on the electric arc the plasma and the contaminated gases are conducted through their respective routes to the discharge area thereof. In this sense, the arc chute (1) comprises discharge routes for said contaminated gases which consist of the hollow internal portion of the contacts (3, 4). As is shown in FIGS. 2 and 4, the contacts (3, 4) and at least a portion of the generation means (6) integral with the moving contact (4) comprise a hollow internal configuration which through their hollow internal portion allow discharging the contaminated gases. In turn, the fixed contact (3) is communicated with at least one discharge area (17) by means of at least one opening (18) comprised in the same fixed contact (3), the contaminated gases passing from the arcing chamber (11) to the discharge area (17) through the fixed contact (3). The discharge area (17) is also communicated by means of one or more openings with the exterior of the arc chute (1) to allow the non-accumulation of contaminated gases in the arc chute (1).

In the switch (5) closing operation, the blowout/intake means (7) allow refreshing the gas in the arc chute (1). The shifting of the moving contact (4) causes the piston (7) to shift, which causes a negative pressure in the compression chamber (10). Due to this negative pressure, the compression chamber (10) is filled with new gas through at least one inlet (14) comprised in the arc chute (1) and which is located on the opposite side farthest from the arcing chamber (11), thus assuring the entrance of clean gas coming from an outer area the farthest possible from the arcing chamber (11), and thus having new gas for the next operation of the switch (5). FIGS. 2 and 4 show at least one inlet (14) through which the new gas enters and comprising at least one closure means (15) preventing the exit of gas in the switch (5) opening operation and allowing the entrance of new gas in the switch (5) closing operation.

The third extinguishing means for extinguishing the electric arc comprised in the switch (5) relates to at least one generation means (2) for generating a magnetic field which allows the electric arc to shift on the contacts (3, 4). When the separation of the fixed (3) and mobile (4) contacts occurs, an electric arc occurs which is quickly transferred to the mobile (9') and fixed (9) arc conducting means, the latter connected to the fixed contact (3) through said generation means (2), whereby the current of the electric arc starts to pass through said generation means (2), which can consist of an electromagnetic coil as is shown in FIGS. 2 and 4, and therefore a magnetic field is generated which causes the electric arc to shift on the arc contact (9), aiding in the cooling thereof for its subsequent extinction by means of this shifting of the electric arc.

THE REFERENCE NUMBERS USED IN THIS TEXT REPRESENT THE FOLLOWING ELEMENTS:

1.—Arc chute
2.—Generation means for generating a magnetic field
3.—Fixed contact
4.—Moving contact
5.—Switch
6.—Generation means for generating a first gas
7.—Blowout/intake means for a second gas
8.—Pinching area
9.—Arc conducting means of the fixed contact (3)
9'.—Arc conducting means of the moving contact (4)
10.—Compression chamber
11.—Arcing chamber
12.—Gas outlet opening of the compression chamber
13.—Gas outlet conduit
14.—Inlet opening for the new gas
15.—Closure means of the inlet (14)
16.—Switching device
17.—Gas discharge area
18.—Opening of the fixed contact towards the discharge area (17)
19.—Part of the arc chute
20.—Part of the arc chute
21.—Front portion of the arc conducting means (9)
22.—Rear portion of the arc conducting means (9)
23.—Compartment of the switch (5)
24.—Blowout coil In this text, the word "comprises" and its variants (such as "comprising", etc.) must not be interpreted in an excluding manner, i.e., they do not exclude the possibility that what has been described may include other elements, steps, etc.

On the other hand, the invention is not limited to the specific embodiments which have been described, but rather it also includes, for example, the variants that can be made by the person having average skill in the art (for example, with respect to the choice of materials, dimensions, components, configuration, etc.), within what is inferred from the claims.

What is claimed is:

1. Gas circuit breaker switch comprising:

an arc chute for each phase, at least partially comprising inside said arc chute a fixed contact and a moving contact, and an arcing chamber inside which an electric arc may occur in the opening and closing of the switch, the entire assembly being insulated in at least one dielectric gas, inside a switching device of electric switchgear, wherein the switch comprises a generation means for generating at least a first extinguishing gas and defining a pinching area in the arcing chamber, along which the moving contact can move in the opening and closing of the switch, at least a portion of the generation means for generating the first extinguishing gas is attached to and moves integrally with the moving contact such that the shifting of the moving contact through the pinching area forces the electric arc to stretch and remain in continuous contact with the generation means for generating the first extinguishing gas, causing the generation of the mentioned first extinguishing gas which allows extinguishing said electric arc, and at least one blowout/intake means for at least a second extinguishing gas, configured to direct the mentioned second extinguishing gas on the electric arc, which allows extinguishing the electric arc in the opening of the switch and refreshing the gas in the arc chute in the closing of the switch.

2. Gas circuit breaker switch according to claim 1, wherein the fixed contact and the moving contact each comprise at least one arc contact, the electric arc being formed between the mentioned arc contacts.

3. Gas circuit breaker switch according to claim 1, wherein the blowout/intake means comprise at least one piston integral with the moving contact, such that in the opening of the switch it compresses the gas located in at least one compression chamber and pushes it towards the arcing chamber for blowing on the electric arc.

4. Gas circuit breaker switch according to claim 1, wherein the electric arc is blown out by a front portion and a rear portion of at least one arc contact in the arcing chamber.

5. Gas circuit breaker switch according to claim 1, according to which in the switch closing operation the piston causes a negative pressure in the compression chamber, causing the entrance of new gas through at least one inlet communicating the inside of the arc chute with the outside.

6. Gas circuit breaker switch according to claim 1, wherein the arc chute, of each phase is configured in at least two parts, such that a first part at least partially incorporates the fixed contact and a second part the moving contact, each of the phases being thus protected and isolated from the remaining phases in any unwanted incident.

7. Gas circuit breaker switch according to claim 1, wherein the fixed contact and/or the moving contact, as well as the generation means, have a hollow internal configuration which, through their hollow internal portion, allow discharging gases and plasma caused by the electric arc during the opening/closing of the switch, which thus aids in discharging the contaminated gas from the arcing chamber at all times.

8. Gas circuit breaker switch according to claim 1, comprising at least one generation means for generating a magnetic field allowing the electric arc to shift on the contacts.

9. Gas circuit breaker switch according to claim 1, wherein the generation means for generating extinguishing gas comprises polyoxymethylene.

10. Gas circuit breaker switch according to claim 1, wherein the gas circuit breaker switch is a three-phase switch.

11. Gas circuit breaker switch according to claim 3, wherein the compression chamber is communicated by means of at least one opening with at least one outlet conduit through which the compressed gas is directed towards the arcing chamber.

12. Gas circuit breaker switch according to claim 5, wherein at least one inlet comprises at least one closure means preventing the exit of gas in the switch opening operation and allows the entrance of new gas into the compression chamber in the switch closing operation.

13. Gas circuit breaker switch according to claim 7, comprising a blowout coil located under the arc contact configured to conduct the gases generated by the electric arc towards the inside of the fixed contact and of the moving contact.

14. Gas circuit breaker switch according to claim 7, wherein the hollow internal portion of the fixed contact is communicated with at least one gas discharge area by means of at least one opening comprising the fixed contact, such that a greater sweeping of gases and plasma produced in the opening/closing of the switch is achieved.

15. Gas circuit breaker switch according to claim 8, wherein the fixed contact comprises at least one electromagnetic coil generating the mentioned magnetic field causing the electric arc to shift.

16. Gas circuit breaker switch comprising:

an arc chute for each phase, each arc chute associated with a fixed contact and a moving contact, and an arcing chamber inside which an electric arc may occur upon at least opening and closing of the switch, the entire assembly being insulated in at least one dielectric gas, inside a switching device of electric switchgear, wherein the switch comprises a generator configured to generate at least a first extinguishing gas and defining a pinching area in the arcing chamber, along which the moving contact moves in the opening and closing of the switch, at least a portion of the generator is attached to and moves integrally with the moving contact such that the shifting of the moving contact through the pinching area forces the electric arc to stretch and remain in continuous contact with the generator, causing the generation of the first extinguishing gas to extinguish said electric arc, and at least one blowout/intake element configured to permit flow of at least a second extinguishing gas and to direct the second extinguishing gas on the electric arc, whereby the electric arc in the opening of the switch is extinguished and the gas in the arc chute in the closing of the switch is refreshed.

* * * * *